US007171134B2

(12) United States Patent
Denton et al.

(10) Patent No.: US 7,171,134 B2
(45) Date of Patent: Jan. 30, 2007

(54) WHITE VECTOR ADJUSTMENT VIA EXPOSURE

(75) Inventors: Gary A. Denton, Lexington, KY (US); Roger S. Cannon, Nicholasville, KY (US); Eric W. Westerfield, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 196 days.

(21) Appl. No.: 11/006,175

(22) Filed: Dec. 7, 2004

(65) Prior Publication Data

US 2006/0120739 A1 Jun. 8, 2006

(51) Int. Cl.
*G03G 15/00* (2006.01)
*G03G 15/02* (2006.01)

(52) U.S. Cl. ..... 399/49; 399/50

(58) Field of Classification Search ..... 399/49, 399/46, 38, 50, 53, 55, 58, 59, 72, 100, 115, 399/128, 153, 168, 169, 260, 296
See application file for complete search history.

(56) References Cited

U.S. PATENT DOCUMENTS 4,506,971 A * 3/1985 Buell et al. ..... 399/296
4,998,266 A * 3/1991 Hillen et al. ..... 378/31
5,155,541 A * 10/1992 Loce et al. ..... 399/232
5,481,343 A * 1/1996 Bhagat ..... 399/274
5,666,591 A * 9/1997 Taya ..... 399/50
6,188,861 B1 * 2/2001 Parker et al. ..... 399/299
6,246,847 B1 * 6/2001 Jeong et al. ..... 399/101
6,408,145 B1 * 6/2002 Ohki ..... 399/50
6,957,030 B2 * 10/2005 Baker, Jr. et al. ..... 399/222
7,023,583 B2 * 4/2006 Kato ..... 358/1.9

* cited by examiner

*Primary Examiner*—Andrew H. Hirshfeld
*Assistant Examiner*—Hoai-An D. Nguyen
(74) *Attorney, Agent, or Firm*—Coats and Bennett, PLLC

(57) ABSTRACT

The white vector—the voltage difference between white areas of a latent image on a photoconductive unit and a developer roller—may be independently adjusted at each photoconductive unit, allowing multiple image forming units to be driven from a shared power supply. The photoconductive unit is charged to a high voltage level relative to the developer roller, and selectively optically discharged to the desired white vector. The voltage of the discharged area may be measured, or may be calculated by increasing the developer roller voltage a predetermined amount, discharging the photoconductive unit until toner is sensed in white image areas, and then reducing the developer roller voltage. The white areas may be discharged using a lower optical power from the writing light source or a different light source, such as a laser, LED or electroluminescent source. A second laser may be of a different wavelength than a writing laser.

32 Claims, 6 Drawing Sheets

WHITE VECTOR ADJUSTMENT VIA EXPOSURE

BACKGROUND

The present invention relates generally to the field of electrophotography and in particular to a method of adjusting a white vector by partial exposure of selected white image areas of the latent image on a photoconductive unit.

The basic electrophotographic process is well known in the art, and described briefly with reference to FIG. 1. FIG. 1 is a schematic diagram illustrating an exemplary image forming unit 10 (for the purpose of this description, only the solid-line elements of FIG. 1 are considered). Each image forming unit 10 includes a photoconductive unit 12, a charging unit 14, an optical unit 16, a developer roller 18, a transfer device 20, and a cleaning blade 22.

In the embodiment depicted, the photoconductive unit 12 is cylindrically shaped and illustrated in cross section. However, it will be apparent to those skilled in the art that the photoconductive unit 12 may comprise any appropriate shape or structure. The charging unit 14 charges the surface of the photoconductive unit 12 to a uniform potential, approximately −1000 volts in the embodiment depicted. A laser beam 24 from a laser source 26, such as a laser diode, in the optical unit 16 selectively discharges discrete areas 28 on the photoconductive unit 12 that are to be developed by toner (also referred to herein as "pels"), to form a latent image on the surface of the photoconductive unit 12. The optical energy of the laser beam 24 selectively discharges the surface of the photoconductive unit 12 to a potential of approximately −300 volts in the embodiment depicted (approximately −100 volts over the photoconductive core voltage of −200 volts in this particular embodiment). Areas of the latent image not to be developed by toner (also referred to herein as "white" or "background" image areas), indicated generally by the numeral 30, retain the potential induced by the charging unit 14, e.g., approximately −1000 volts in the embodiment depicted.

The latent image thus formed on the photoconductive unit 12 is then developed with toner from the developer roller 18, on which is adhered a thin layer of toner 32. The developer roller 18 is biased to a predetermined voltage intermediate to the voltage of the latent image areas to be developed and the latent image areas not to be developed, such as approximately −600 volts in the embodiment depicted. Negatively charged toner 32 is attracted to the more-positive discharged areas 28, or pels, on the surface of the photoconductive unit 12 (i.e., −300V vs. −600V). The toner 32 is repelled from the less-positive, non-discharged areas 30, or white image areas, on the surface of the photoconductive unit 12 (i.e., −1000V vs. −600V), and consequently the toner 32 does not adhere to these areas. As well known in the art, the photoconductive unit 12, developer roller 18 and toner 32 may alternatively be charged to positive voltages.

In this manner, the latent image on the photoconductive unit 12 is developed by toner 32, which is subsequently transferred to a media sheet 34 by the positive voltage of the transfer device 30, approximately +1000V in the embodiment depicted. Alternatively, the toner 32 developing an image on the photoconductive unit 12 may be transferred to an Intermediate Transfer Mechanism (ITM) such as a belt 36 (see FIG. 3), and subsequently transferred to a media sheet 34. The cleaning blade 22 then removes any remaining toner from the photoconductive unit 12, and the photoconductive unit 12 is again charged to a uniform level by the charging device 14.

The above description relates to an exemplary image forming unit 10. In any given application, the precise arrangement of components, voltages, and the like may vary as desired or required. As known in the art, an electrophotographic image forming device may include a single image forming unit 10 (generally developing images with black toner), or may include a plurality of image forming units 10, each developing a different color plane separation of a composite image with a different color of toner (generally yellow, cyan and magenta, and optionally also black).

Additionally, in the above description, the toner 32 is dry, and toner particles adhere directly to the developer roller 18 and pels of the photoconductive unit 12. As known in the art, in another embodiment, the toner may comprise a liquid medium in which electrically charged, pigmented toner particles are suspended. One or more colors of liquid toner may be successively applied to the developer roller 18 by an appropriate fluid delivery mechanism (not shown), with each color of toner selectively removed from the developer roller 18 following development of the associated image color plane on the photoconductive unit 12. Alternatively, the image forming device may include a plurality of image forming units 10, each such unit 10 applying a different color liquid toner. The liquid toner develops the latent image on the photoconductive unit 12, and the developed image is transferred to an ITM 36 or a media sheet 34, as described above. Additional steps such as drying, cleaning, liquid removal and recovery and the like may be required, as known in the art. The present invention is not limited to dry toner 32, and liquid toner based image forming devices are within its scope.

The difference in potential between non-discharged areas 30 on the surface of the photoconductive unit 12—that is, white image areas or areas not to be developed by toner—and the surface potential of the developer roller 18 is known as the "white vector." This potential difference (with the white image areas 30 on the surface of the photoconductive unit 12 being less positive than the surface of the developer roller 18) provides an electro-static barrier to the development of negatively charged toner 32 on the white image areas 30 of the latent image on the photoconductive unit 12. A sufficiently high white vector is necessary to prevent toner development in white image areas; however, research indicates that an overly large white vector detrimentally affects the formation of fine image features, such as small dots and lines. In exemplary embodiments of image forming devices, a white vector of 200–250V results in acceptable image quality while preventing toner development in white image areas.

The optimal white vector for each image forming unit 10 within an image forming device may be different, due to differing toner formulations, component variation, difference in age or past usage levels of various components, and the like. One way to achieve a different white vector at each image forming unit 10 is to power each charging device 14 to the desired non-discharged potential (e.g., the potential of the corresponding developer roller 18 plus the desired white vector). This would generally require a separate power supply for charging the photoconductive unit 12 in each image forming unit 10, increasing the image forming device cost and weight, reducing reliability, and precluding a compact design, as each power supply requires space.

SUMMARY

In one aspect, the present invention relates to a method of adjusting the voltage of a photoconductive unit relative to an associated developer roller in an image forming device. The surface of the photoconductive unit is uniformly charged to a first voltage. The surface of the photoconductive unit is selectively optically discharged to a second voltage at predetermined locations to be developed by toner. The surface of the developer roller is biased to a third voltage that is intermediate to the first and second voltages. The surface of the photoconductive unit is selectively optically discharged to a fourth voltage at selected locations not to be developed by toner, the fourth voltage being intermediate to the first and third voltages. The discharge of locations not to be developed by toner may be accomplished by a lower level of optical energy from the same laser source that selectively discharges locations to be developed by toner. Alternatively, these locations may be discharged by optical energy from a separate light source, such as an LED or an electroluminescent source.

In another aspect, the present invention relates to a method of establishing a predetermined voltage difference between a photoconductive unit and an associated developer roller having an operating voltage in an image forming device. The surface of the photoconductive unit is uniformly charged to a first voltage. The surface of the developer roller is biased to a third voltage intermediate to the first voltage and the operating voltage, and differing from the operating voltage by a predetermined amount. The surface of the photoconductive unit is optically discharged to a second voltage causing a threshold of development at which toner is transferred from the developer roller to the photoconductive unit in at least one area at the second voltage. After reaching the threshold of development, the surface of the developer roller is biased to the operating voltage.

In yet another aspect, the present invention relates to an electrophotographic image forming device including at least one photoconductive unit. The image forming device also includes at least one corresponding optical unit operative to form a latent image on the photoconductive unit by selective optical illumination thereof, the optical unit including a first laser source generating coherent optical energy at a first wavelength, and a second laser source generating coherent optical energy at a second wavelength.

In still another aspect, the present invention relates to an electrophotographic image forming device including at least two image forming units, each comprising a photoconductive unit and a developer roller biased to a first voltage level. The device includes a power supply providing power to charge two or more photoconductive units to a second voltage having the same polarity and a greater magnitude than the first voltage. The device also includes an optical unit associated with each image forming unit, each optical unit operative to selectively discharge the associated photoconductive unit surface to a third voltage having the same polarity and a lower magnitude than the first voltage at predetermined locations to be developed by toner, and to selectively discharge the surface of the photoconductive unit to a fourth voltage at selected locations not to be developed by toner, the fourth voltage having the same polarity and a greater magnitude than the first voltage and having the same polarity and a lower magnitude than the second voltage, and the fourth voltage having different values on at least two photoconductive unit.

In still another aspect, the present invention relates to an electrophotographic image forming device including a photoconductive unit and a charger unit charging the surface of the photoconductive unit to a first voltage. The device also includes an optical unit comprising a plurality of light sources arrayed across the photoconductive unit and forming a latent image thereon by independently selectively discharging the surface of the photoconductive unit to at least a second voltage by optical illumination thereof. The device further includes a developer roller having a surface biased to a third voltage intermediate to the first and second voltages and operative to transfer toner to the photoconductive unit. Additionally, the device includes a controller selectively driving at least one the light source to generate optical energy to discharge the photoconductive unit to the second voltage at locations to be developed by toner, and selectively driving at least one the light source to generate optical energy to discharge the photoconductive unit to a fourth voltage at selected locations not to be developed by toner, the fourth voltage intermediate to the first and third voltages.

DETAILED DESCRIPTION

Figure 2:
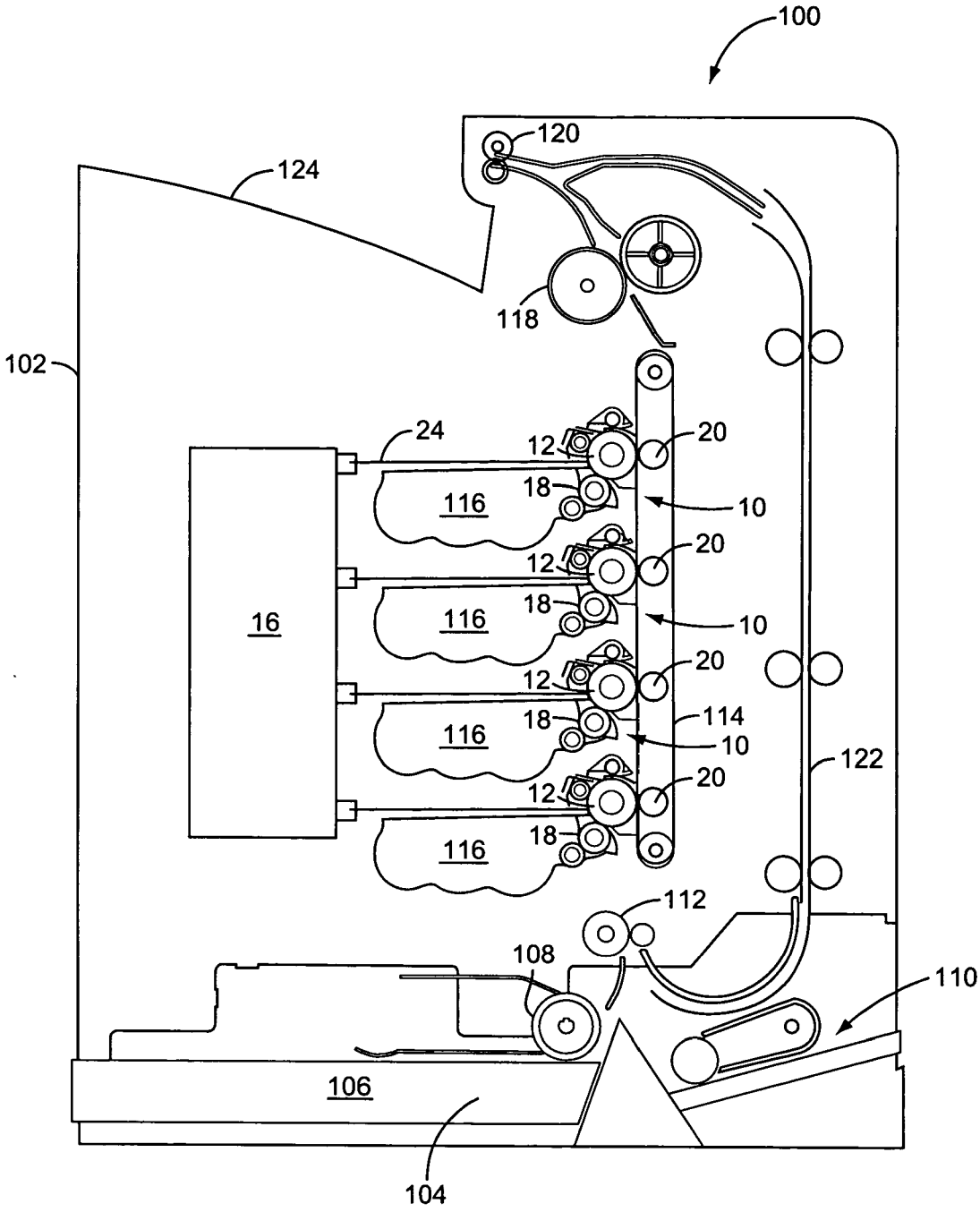
FIG. 2 is a schematic diagram of a direct-transfer image forming device.

The present invention relates to a method of adjusting the voltage difference between a photoconductive unit 12 and a developer roller 18 in an electrophotographic image forming device. FIG. 2 depicts a representative direct-transfer image forming device, indicated generally by the numeral 100. The image forming device 100 comprises a housing 102 and a media tray 104. The media tray 104 includes a main media sheet stack 106 with a sheet pick mechanism 108, and a multipurpose tray 110 for feeding envelopes, transparencies and the like. The media tray 104 may be removable for refilling, and located in a lower section of the device 100.

Within the image forming device housing 102, the image forming device 100 includes media registration roller 112, a media sheet transport belt 114, one or more removable developer cartridges 116, photoconductive units 12, developer rollers 18 and corresponding transfer rollers 20, an imaging device 16, a fuser 118, reversible exit rollers 120, and a duplex media sheet path 122, as well as various additional rollers, actuators, sensors, optics, and electronics (not shown) as are conventionally known in the image forming device arts, and which are not further explicated herein. Additionally, the image forming device 100 includes one or more controllers, microprocessors, DSPs, or other stored-program processors (not shown) and associated computer memory, data transfer circuits, and/or other peripherals (not shown) that provide overall control of the image formation process.

Figure 1:
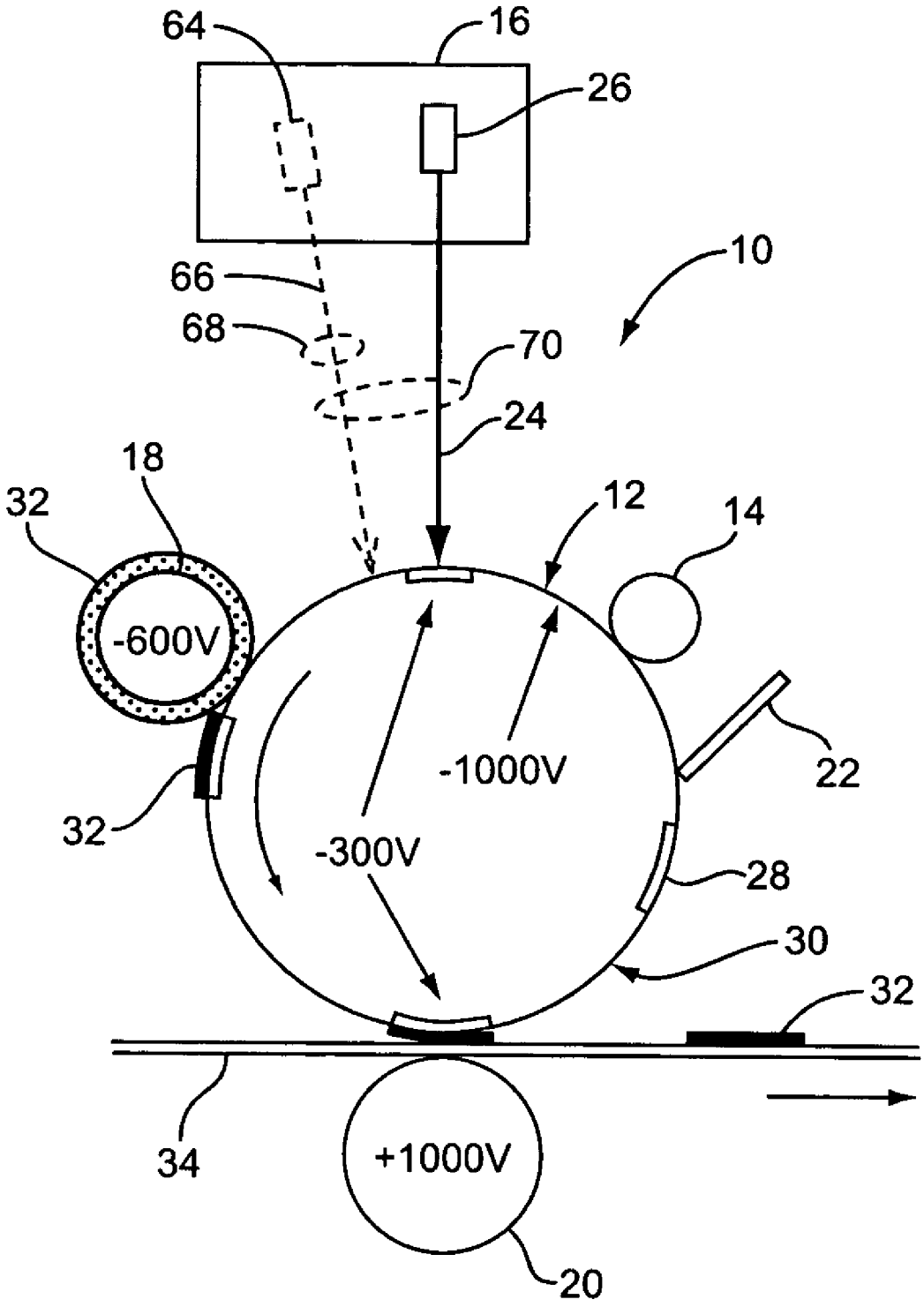
FIG. 1 is a schematic diagram of an image forming unit.

Each developer cartridge 116 includes a reservoir containing toner 32 and a developer roller 18, in addition to various rollers, paddles and other elements (not shown). Each developer roller 18 is adjacent to a corresponding photoconductive unit 12, with the developer roller 18 developing a latent image on the surface of the photoconductive unit 12 by supplying toner 32. In various alternative embodiments, the photoconductive unit 12 may be integrated into the developer cartridge 116, may be fixed in the image forming device housing 102, or may be disposed in a removable photoconductor cartridge (not shown). In a typical color image forming device, three or four colors of toner—cyan, yellow, magenta, and optionally black—are applied successively (and not necessarily in that order) to a print media sheet to create a color image. Correspondingly, FIG. 1 depicts image forming units 10. In a monochrome printer, only one forming unit 10 may be present.

The operation of the image forming device 100 is conventionally known. Upon command from control electronics, a single media sheet is "picked," or selected, from either the primary media stack 106 or the multipurpose tray 110. Alternatively, a media sheet may travel through the duplex path 122 for a two-sided print operation or reprinting on the first side. Regardless of its source, the media sheet is presented at the nip of registration roller 112, which aligns the media sheet and precisely times its passage on to the image forming stations downstream. The media sheet then contacts the transport belt 114, which carries the media sheet successively past the image forming units 10. As described above, at each photoconductive unit 12, a latent image is formed thereon by optical projection from the imaging device 16. The latent image is developed by applying toner to the photoconductive unit 12 from the corresponding developer roller 18. The toner is subsequently deposited on the media sheet as it is conveyed past the photoconductive unit 12 by operation of a transfer voltage applied by the transfer roller 20. Each color is layered onto the media sheet to form a composite image, as the media sheet 34 passes by each successive image forming unit 10.

The toner is thermally fused to the media sheet by the fuser 118, and the sheet then passes through reversible exit rollers 120, to land facedown in the output stack 124 formed on the exterior of the image forming device housing 102. Alternatively, the exit rollers 120 may reverse motion after the trailing edge of the media sheet has passed the entrance to the duplex path 122, directing the media sheet through the duplex path 122 for the printing of another image on the back side thereof, or forming additional images on the same side.

Figure 3:
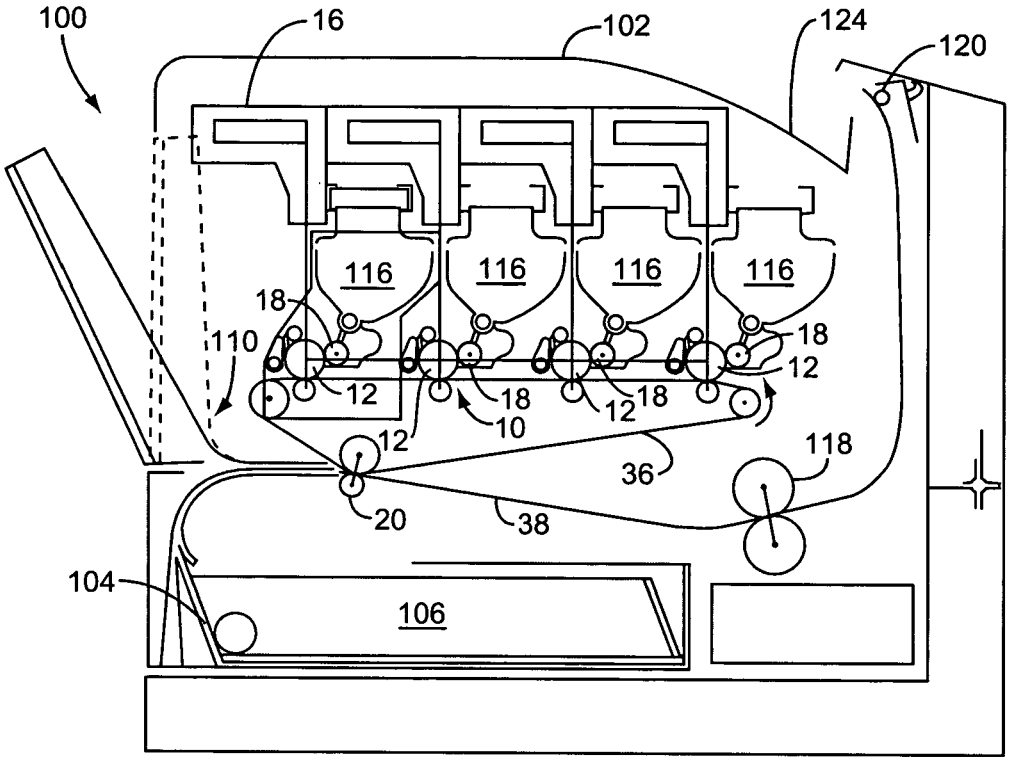
FIG. 3 is a schematic diagram of an indirect-transfer image forming device.

FIG. 3 depicts an alternative configuration of image forming device 100, wherein functional components are numbered consistently with FIGS. 1 and 2. In this embodiment, toner images are transferred from photoconductive units 12 to an Intermediate Transfer Mechanism (ITM), such as belt 36. A composite toner image is then transferred from the ITM belt 36 to a media sheet 34 moving along the media path 38 by a transfer voltage applied by the transfer roller 20.

In any electrophotographic printer, a key factor for achieving acceptable print quality is control of the white vector, that is, the difference in potential between areas of a latent image on the surface of the photoconductive unit 12 not to be developed by toner (e.g., "white" image areas) and the surface potential of the developer roller 18. In monochrome image forming devices having a single image forming unit 10, maintaining a desired white vector is fairly straightforward. However, in color image forming devices having a plurality of image forming units 10, maintaining the appropriate white vector at each image forming unit 10 (which may, in general, be different from any other image forming unit 10) is more problematic, and conventionally requires separate power supplies to power the charging device 14 of each image forming unit 10.

According to the present invention, in an image forming device wherein two or more charging devices 14 share at least one power supply to charge two or more associated photoconductive units 12, the white vector at each image forming unit 10 may be independently controlled by a partial optical discharge of the surface potential of white image areas on the latent image on the photoconductive unit 12. In one embodiment, a single laser source 26 (such as for example a laser diode) in the optical unit 16 both discharges areas of the latent image on the photoconductive unit 12 to be developed by toner, as conventionally known, and additionally partially discharges selected white image areas of the latent image on the photoconductive unit 12.

As discussed above, the white vector provides an electrostatic barrier to the development of white, or background, areas of the latent image. Thus, a high white vector is preferred in white image areas. However, control of the white vector (in particular, a lower white vector than is commonly employed in the prior art) has been found to be important in achieving acceptable image quality for fine image features, such as small dots and lines. Consequently, in one embodiment of the present invention, the white vector may only be adjusted to optimal values in image areas that are close to developed areas—that is, image locations that are within a predetermined distance of a pel, or toner-developed dot. In expansive white image areas—that is, image areas not within a predetermined distance of a pel—the white vector may advantageously be maintained at a high value. This ensures no stray toner is developed onto white image areas, without adversely affecting the quality of fine image features in developed areas of the image. Each image may be analyzed within a print engine or other processor or controller (not shown) within the image forming device, or in a computer attached to the image forming device, to determine which white image areas of the latent image on the photoconductive unit 12 should be partially discharged to control the white vector.

In particular, according to the present invention, the white vector is preferably controlled, at least in the area of developed pels, to a value from about 100 volts to about 500 volts. More preferably, the white vector ranges from about 150 volts to about 350. Most preferably, the white vector according to the present invention is in the range from about 175 volts to about 250 volts.

Conventionally, the laser source 26 is toggled between "on," or lasing, and "off," or non-lasing states, according to image data as the laser beam 24 scans along an image scan line. In the "on" state, the laser source 26 may produce a laser output power of 2–5 mw in an exemplary embodiment, and 0–0.4 mw laser power in the "off" state.

According to one embodiment of the present invention, control electronics (not shown) in the optical unit 16 may adjust the "off" current supplied to the laser source 26. In this modified "off" state, i.e., when scanning selected white areas of the latent image, the laser source 26 is actually generating a low intensity, "background" laser beam 24 that illuminates, and thus partially discharges, selected white areas of the latent image on the photoconductive unit 12.

In an exemplary embodiment, the laser source 26 may produce an optical output power of 0.1–0.4 mw in the modified "off" state. An additional benefit of this embodiment of the present invention is that the response time of the laser source 26 may actually improve, as the laser source 26 does not need to transition from a non-lasing to a lasing state to write a pel to the latent image on the photoconductive drum 12. This improved response time may allow for higher print speeds with greater image quality than is possible with the conventional binary toggling of the laser source 26. Note that the modified "off" state of this embodiment of the present invention comprises actively driving the writing light source 26 to produce optical energy, albeit at a lower level than when driving the light source 26 in the "on" state. This low-power output during the modified "off" state is distinguished, for example, from spurious optical energy emitted by a light source during the transient period following a transition from "on" to "off," or from extremely low optical energy emitted by the light source due to leakage current or the like.

To actively adjust the bias current to the laser source 26, the magnitude of voltage discharge in white image areas at the surface of the photoconductive unit 12 should be monitored. In one embodiment, this voltage is monitored by an electrostatic voltmeter probe proximate the surface of the photoconductive unit 12, downstream from the laser exposure position. In another embodiment, the cost of an electrostatic voltmeter at each image forming unit 10 may be avoided, and the proper bias current to the laser source 26 to produce the desired white vector may be determined using a toner patch sensor.

As known in the art, a toner patch sensor is an optical sensor that monitors a media sheet 34, a media sheet transport belt 114, or an ITM belt 36, as appropriate, to sense various test patterns printed by the various image forming units 10 in an image forming device 100 for, among other purposes, registering the various color planes printed by the image forming units 10. In an exemplary embodiment of the present invention, the toner patch sensor may be used to set the bias current to the laser source 26 to achieve a desired white vector, according to a method described with reference to FIG. 4.

Initially, the surface voltage of the developer roller 18 is increased from a predetermined operating voltage (such as −600 volts in the embodiment depicted in FIG. 1) to a value equal to the operating voltage plus the desired white vector (for example, −850 volts for a 250 volt white vector), as indicated at step 40. The white image area of the latent image on the photoconductive unit 12 is then illuminated with a low intensity discharge beam during the formation of a latent image, as indicated at step 42. In one embodiment, this may comprise biasing the current supplied to the laser source 26 to a value just above the lasing threshold.

An operation is then performed at step 44 to ascertain whether the image forming unit 10 has reached a threshold of development. As used herein, the "threshold of development" is the point at which toner is first developed to white image areas of the latent image on the photoconductive unit 12. That is, the point at which toner is erroneously attracted from the developer roller 18 to areas of the photoconductive unit 12 that are not intended to be developed with toner. In one embodiment, this may comprise printing one or more test patterns to a media sheet 34, a media sheet transfer belt 114 or an ITM belt 36, the patterns including at least some "white" areas on which no toner is to be developed. A toner patch sensor may then sense the test patterns, and the threshold of development detected when toner is sensed in at least one white image area. However, the present invention is not limited to the use of a toner patch sensor to detect the threshold of development. For example, one or more images containing at least one white area may be printed to a media sheet 34, which is output for inspection by a user. The user may subsequently input an indication of whether the threshold of development has been reached, such as for example via an input panel.

If the threshold of development has not been reached at step 44, then the intensity of the white image area discharge beam, or "background" beam (e.g., in one embodiment, the intensity of the laser beam 24 when the laser source 26 is in the "off" state) is incrementally increased, as indicated at step 46, and a subsequent latent image is formed on the photoconductive unit 12, illuminating the white image areas with the background beam indicated at step 42. This process is repeated until the threshold of development is reached at step 44. When the threshold of development has been reached, then the surface voltage of the developer roller 18 is reduced from the elevated value (the operating voltage plus the white vector) to the predetermined operating voltage of the developer roller 18, as indicated at step 48. At this point, the background beam is discharging the surface potential of the photoconductive unit 12 in white image areas to a value that is more negative than the surface potential of the developer roller 18 by substantially the desired white vector value. As discussed further herein, the above method for establishing a background intensity of illumination for white image areas to achieve a desired white vector is not limited to the embodiment wherein the "off" state of the laser source 26 is set above the lasing threshold.

Figure 5:
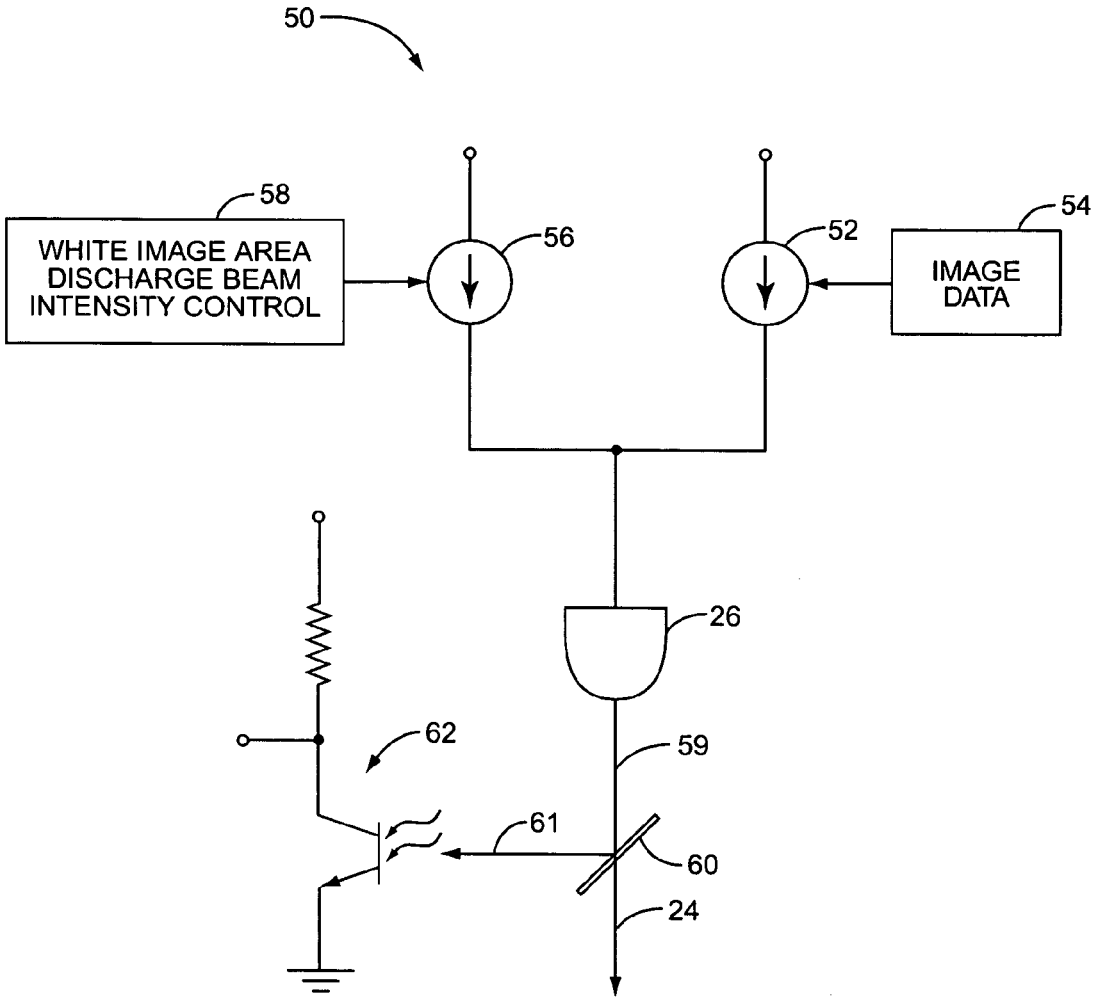
FIG. 5 is a schematic diagram of a laser with two current sources.

According to another embodiment of the present invention, the laser source 26 (such as a laser diode) is driven by two current sources, as depicted in FIG. 5 and indicated generally by the numeral 50. A "writing" current source 52 is modulated by image data from a controller 54. The writing current source 52 and controller 54 are conventional, and drive the laser source 26 with a bias current in the "on" state to discharge pels, or image areas on the latent image on the photoconductive unit 12 to be developed by toner (the writing current source 52 provides no current in the "off" state).

In addition, the circuit 50 includes a "background" or white image area discharge current source 56, controlled by a white image area discharge beam intensity control circuit 58. In one embodiment, the control circuit 58 may implement the white vector calibration method disclosed above with reference to FIG. 4, to set a background beam intensity that results in a desired white vector. Currents from the writing current source 52 and background current source 56 are summed together and drive the laser source 26. In this manner, the laser source 26 receives current from the background current source 56 to drive it above the lasing threshold when the writing current source 52 is in an "off" state and supplying no drive current.

In this embodiment, the addition of current from the background current source 56 to the current from writing current source 52, when the writing current source 52 is in an "on" state may result in excessive peak current being applied to the laser source 26. To control the overall bias current for the laser source 26, the laser output beam 59 of the laser source 26 may be directed to a beam splitter 60. The beam splitter 60 is a well-known optical component that generates a secondary beam 61 from the laser output beam 59, and passes a primary beam 24 through to subsequent optics and on to the photoconductive unit 12. The secondary beam 61 is generated from a surface reflection of the beam splitter 60, and is typically in the range of 4 to 8% of the power of the laser output beam 59. Accordingly, the primary beam 24 contains approximately 92 to 96% of the optical energy of the laser output beam 59.

The secondary beam 61 is directed to an optical sensing and measuring circuit 62 which may for example comprise an appropriately biased phototransistor. While the secondary beam 61 contains a small fraction of the optical energy of the primary beam 24, it is proportional, and the intensity of the primary beam 24 (and hence that of the output laser beam 59) can be determined by applying a multiplier to the measured intensity of the secondary beam 61. In this manner, the intensity of the output laser beam 59 may be monitored, and the writing current source 52 adjusted so as not to exceed predetermined limits, when the current from the writing current source 52 is added to that from the background current source 56. The dual current circuit 50 of FIG. 5 requires two current sources, but only one laser source 26.

According to yet another embodiment of the present invention, the optical unit 16 associated with each image forming unit 10 may include two laser sources. FIG. 1 depicts the primary, or writing laser source 26 generating a primary or writing laser beam 24. Also depicted, in dotted line fashion, is a separate, background laser source 64, generating a background laser beam 66. The background laser source 64 (such as a laser diode) may be the same wavelength as the writing laser source 26, or it may be a different wavelength. In either case, the background laser beam 66 may be directed through optics 68. The optics 68 may include an optical attenuator operative to reduce the intensity of the background laser beam 66 striking the surface of the photoconductive unit 12. This allows the background laser source 64 to be operated within its designed operating range, well above the threshold of lasing. Driving the background laser source 64 well above the threshold of lasing simplifies the task of adjusting the bias current for the background laser source 64, and reduces dependency on component variations, environmental conditions, and the like. In one embodiment, the background laser optics 68 may include one or more lenses to slightly defocus the background laser beam 66. By spreading the optical energy incident upon the photoconductive unit 12 slightly from a tightly focused pinpoint beam, a more uniform "wash" or diffuse discharge of white image areas of the latent image may be achieved.

According one embodiment of the present invention, the writing laser source 26 and the background laser source 64 may be of different wavelengths. In particular, in one embodiment, the writing laser source 26 and background laser source 64 may comprise an integrated dual-wavelength laser diode, such as part number GH30707A2A available from Sharp Electronics. This low-cost device, developed for use in DVD players and similar applications, includes two laser emitters, nominally at 788 nm (infrared) and 654 nm (visible red). In one embodiment, one of the lasers 26 (e.g., 654 nm) may generate the writing beam 24, and the other laser 64 (e.g., 788 nm) may generate the background beam 66.

If the different wavelength laser sources 26 and 64 share common optics 70, then the lasers will not both focus at the same plane (such as the surface of the photoconductive unit 12). This is due to a phenomenon called chromatic aberration, and stems from the fact that the index of refraction of any optical element 70 is dependent on wavelength. Thus, optics that are precisely focused for one wavelength will defocus light of all other wavelengths to varying degrees. This property is advantageous in the present invention, in that the common optics 70 may be optimized to precisely focus the writing laser beam 24, and consequently will slightly defocus the background laser beam 66. As described above, the defocusing of the background laser beam 66 improves its uniformity in discharging white image areas of the latent image on the photoconductive unit 12 by slightly "spreading" the beam 66.

Additionally, the common optics 70 may include at least one optical element with a dichroic, or wavelength-selective, coating that significantly attenuates only the wavelength of the background laser beam 66, and not the writing laser beam 24. As discussed above, this allows the background laser source 64 to be operated in its operating range, well away from the threshold of lasing.

According to another embodiment of the present invention, selective attenuation of the background light beam 66 may be achieved via one or more polarizing filters in optics 66 or 70. Where the writing laser source 26 and background light source 64 are separate light sources, the background light source 64 may be a polarized laser source, or alternatively the background light beam 66 may be polarized at the source 64 by a polarizing filter (not shown). A polarized filter in the optics 68 or 70 may then be rotated about the longitudinal axis of the background light beam 66—or alternatively, the background light source 64 or its polarizing filter may be rotated with respect to the central axis of the optics 68 or 70—to achieve a variable attenuation of the intensity of the background light beam 66 at the surface of the photoconductive unit 12. When the background light source 64 is a laser source, this allows the background laser source 64 to be driven in its designed operating range, while projecting only a low intensity background light beam 66 on the white image areas of the latent image on the photoconductive unit 12.

According to still another embodiment of the present invention, the background optical source 64 may comprise a non-coherent optical source, such as an LED. The LED generates a light beam 66, which may optionally be attenuated and/or focused by optics 68 prior to illuminating and thus discharging white image areas on the latent image on the surface of the photoconductive unit 12.

According to yet another embodiment of the present invention, the background light source 64 may comprise an electroluminescent source. As known in the art, electroluminescent optical sources commonly comprise a laminated assembly including a phosphor material, a dielectric layer, and front and rear electrodes. By applying alternating electric fields across the electrodes, the phosphor is excited to emit radiant optical, e.g. luminescent, energy 66. The electroluminescent light source 64 may be disposed within the optical unit 16, as depicted in FIG. 1. Alternatively, the electroluminescent source 64 may be formed as a strip, and disposed proximate and substantially parallel to the photoconductive unit 12.

Figure 6:
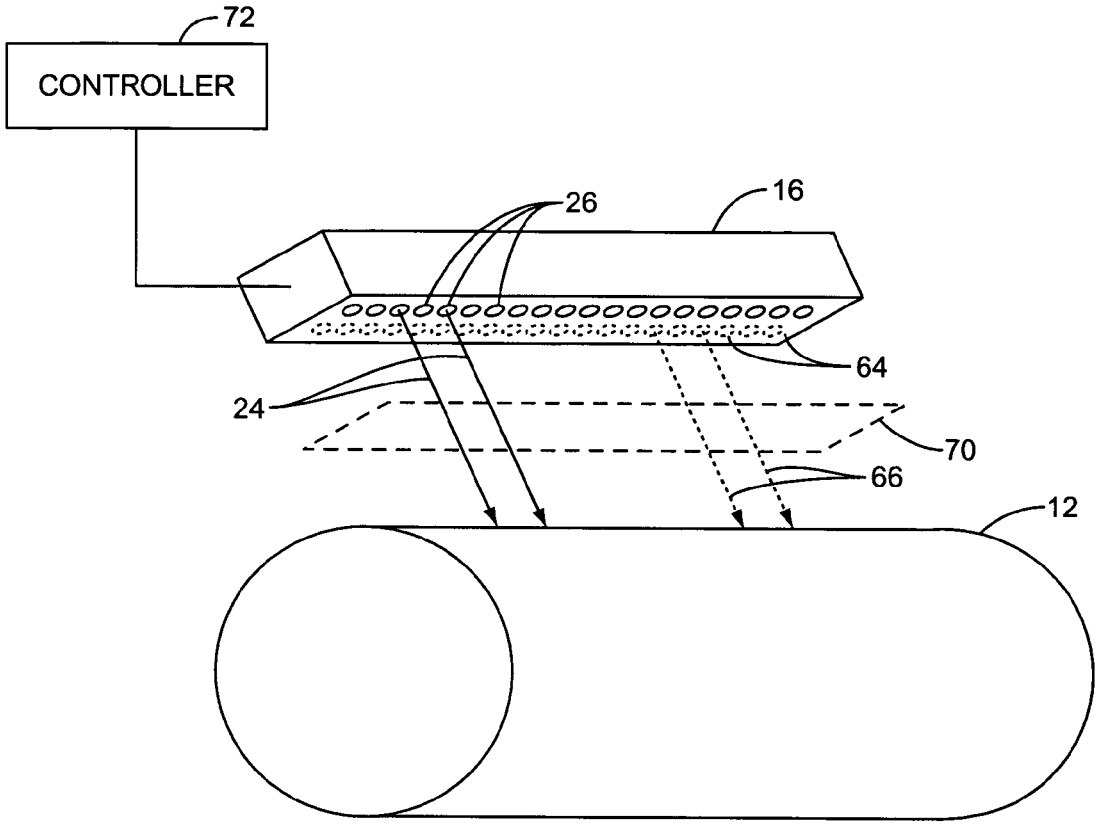
FIG. 6 is a perspective view of a photoconductive drum and optical unit.

FIG. 6 depicts an arrayed optical unit 16, as known in the art, wherein a plurality of discrete, independently controlled light sources, such as LEDs 26, form a latent image on the surface of a photoconductive unit 12 by optical illumination thereof. Rather than scanning a light beam (such as a laser beam) across the surface of the photoconductive unit 12 while modulating the beam between "on" and "off" states, as describe above, a controller 72 controlling the optical unit 16 of FIG. 6 independently toggles each LED 26 between "on" and "off" states to simultaneously selectively discharge a "scan line" of the surface of the photoconductive unit 12 and thereby form a latent image to be developed by toner 32.

According to the present invention, a low level optical beam may be generated at each LED 26 during the "off" state, to partially discharge the white image areas of the latent image on the photoconductive unit 12. This may be accomplished several ways. In one embodiment, the controller 72 drives each LED 26 in the array with a first current in the "on" state, and with a second current, lower than the first current, in the "off" state. In particular, in one embodiment, at least the second current may result from pulse-width modulating the current to the LED 26. Pulse-width modulation is a technique well known in the art whereby the total current supplied to a load is controlled by altering the duration of time during each of a series of repetitive periods in which current is driven. In other words, by controlling the "duty cycle" of periodically driving current to the load, the net current received by the load may be precisely controlled. Pulse-width modulation may find particular utility in applications where the controller 72 is digital. In another embodiment of the present invention, the current received by each LED 26 in the array is the sum of separate current sources, as depicted in FIG. 5, and as described herein.

In another embodiment, each writing light source 26 may be accompanied by a background light source 64, such as an LED. The writing source 26 and background source 64 may be of different wavelengths, and optical energy from the background source may be selectively attenuated by optics 70 interposed in the optical path, as described with respect to FIG. 1. In yet another embodiment, background light sources 64 may by polarized, and selectively attenuated by a polarizing filter or the like included in the optics 70. Selective attenuation of the background light source 64 may allow the source 64 to be driven in its designed operating range. In any of these embodiments, one or both of the writing light source 26 and background light source 64 may be laser sources, such as laser diodes.

Figure 4:
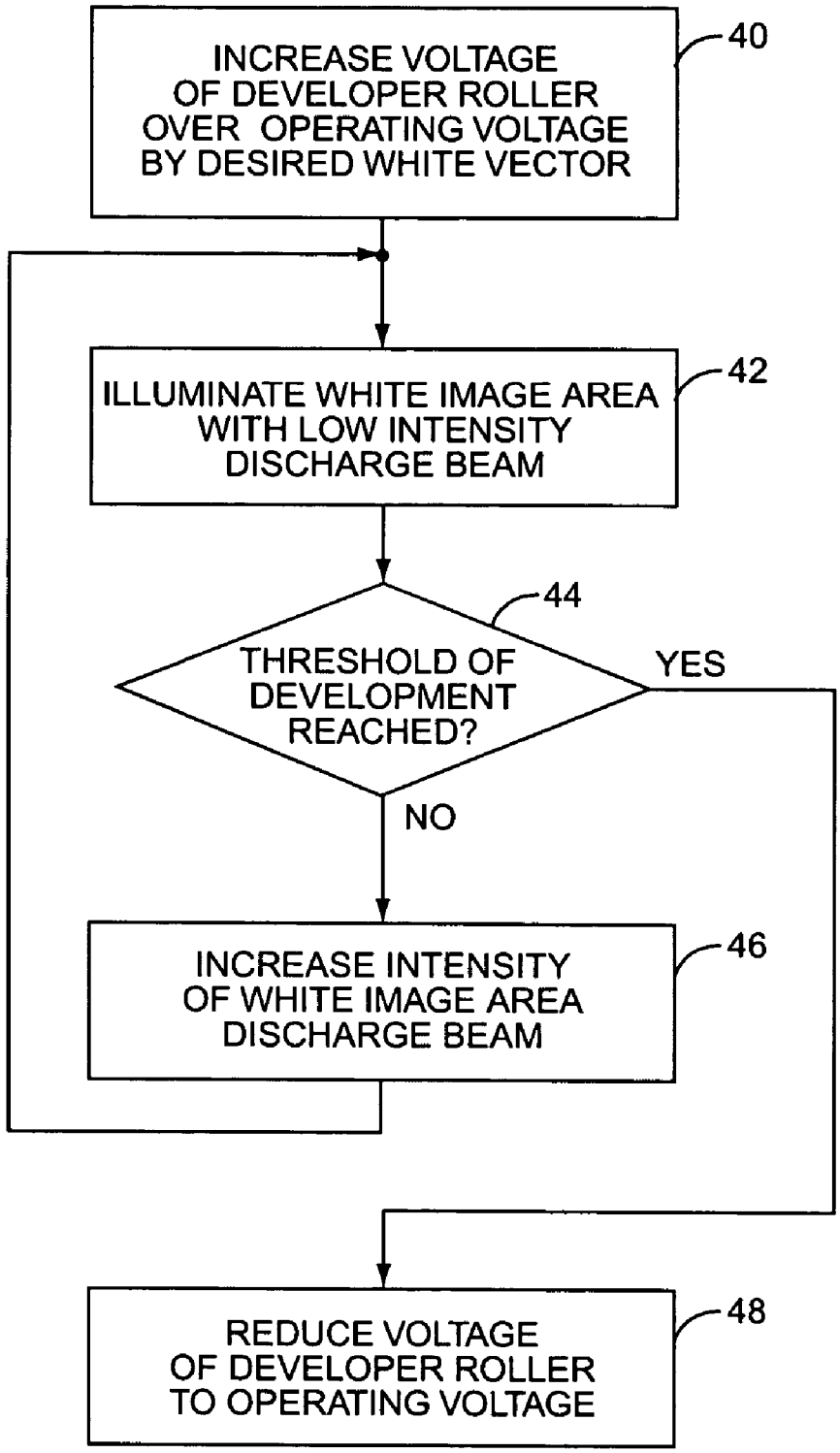
FIG. 4 is a flow diagram of a method of establishing a white vector.

In all of the above-described embodiments, the level or intensity of the background light source may be determined according to the method described with respect to FIG. 4. In particular, the method may include the use of one or more toner patch sensors to detect the threshold of development, and thereby adjust the background optical source to achieve the desired white vector.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A method of adjusting the voltage of a photoconductive unit relative to an associated developer roller in an image forming device, comprising:

uniformly charging the surface of said photoconductive unit to a first voltage;

selectively optically discharging the surface of said photoconductive unit to a second voltage at predetermined locations to be developed by toner; and biasing the surface of said developer roller to a third voltage that is intermediate to said first and second voltages; and selectively optically discharging the surface of said photoconductive unit to a fourth voltage at selected locations not to be developed by toner, said fourth voltage being intermediate to said first and third voltages.

2. The method of claim 1 wherein selectively optically discharging the surface of the photoconductive unit to a second voltage at predetermined locations to be developed by toner comprises illuminating said predetermined locations with a first level of optical energy from a first light source.

3. The method of claim 2 wherein discharging the surface of the photoconductive unit to a fourth voltage at selected locations not to be developed by toner comprises illuminating said locations not to be developed by toner with a second level of optical energy from said first light source less than said first level of optical energy.

4. The method of claim 3 wherein illuminating said locations not to be developed by toner with a second level of optical energy comprises driving said first light source with a predetermined current to generate said second level of optical energy.

5. The method of claim 3 further comprising selecting said second level of optical energy to achieve a predetermined difference between said fourth voltage and said third voltage.

6. The method of claim 5 wherein said predetermined voltage difference is in the range from about 100 volts to about 500 volts.

7. The method of claim 6 wherein said predetermined voltage difference is in the range from about 150 volts to about 350 volts.

8. The method of claim 7 wherein said predetermined voltage difference is in the range from about 175 volts to about 250 volts.

9. The method of claim 5 further comprising measuring said fourth voltage on said photoconductive unit.

10. The method of claim 5 wherein selecting said second level of optical energy to achieve a predetermined difference between said fourth voltage and said third voltage comprises:

increasing the voltage of said developer roller a predetermined amount from said third voltage to a fifth voltage less than said first voltage;

successively incrementally increasing said second level of optical energy from a value at which toner is not developed at one or more said locations not to be developed by toner, to a value at which toner is developed at one or more said locations not to be developed by toner; and decreasing the voltage of said developer roller from said fifth voltage to said third voltage.

11. The method of claim 10 further comprising, at each said second level of optical energy, forming one or more test images including one or more areas of zero toner density, and detecting toner developed in said one or more areas of zero toner density by a sensor.

12. The method of claim 11 wherein forming said one or more test images comprises forming said one or more test images on an intermediate transfer unit.

13. The method of claim 11 wherein forming said one or more test images comprises forming said one or more test images on a media sheet transport belt.

14. The method of claim 11 wherein forming said one or more test images comprises forming said one or more test images on a media sheet.

15. The method of claim 10 further comprising driving said first light source from a single current source, said current source alternating between a first current operative to generate said first level of optical energy and a second current operative to generate said second level of optical energy.

16. The method of claim 10 further comprising driving said first light source from both a first and second current source, said first current source supplying a current selectively alternating between a non-zero current and zero current, and said second current source supplying a substantially constant current operative to generate said second level of optical energy from said first light source when said first current source generates zero current.

17. The method of claim 16 further wherein said first light source generates said second level of optical energy when said first current source supplies a non-zero current.

18. The method of claim 1 wherein selectively optically discharging the surface of the photoconductive unit to a second voltage at predetermined locations to be developed by toner comprises illuminating said predetermined locations with a first level of optical energy from a first light source.

19. The method of claim 18 wherein discharging the surface of the photoconductive unit to a fourth voltage at selected locations not to be developed by toner comprises illuminating said locations not to be developed by toner a second level of optical energy from said first light source, said second level of optical energy lower than said first level of optical energy.

20. The method of claim 18 wherein discharging the surface of the photoconductive unit to a fourth voltage at selected locations not to be developed by toner comprises illuminating said locations not to be developed by toner with optical energy from a second light source.

21. The method of claim 18 further comprising optically attenuating optical energy from said second light source along an optical path from said second light source to said photoconductive unit.

22. The method of claim 21 wherein optically attenuating optical energy from said second light source comprises interposing a dichroic coating in said optical path.

23. The method of claim 21 wherein optically attenuating optical energy from said second light source comprises polarizing optical energy from said second light source, and selectively rotating one of said second light source and a polarized filter interposed in said optical path.

24. The method of claim 18 wherein optically discharging the surface of said photoconductive unit to a fourth voltage at selected locations not to be developed by toner comprises illuminating said locations not to be developed by toner with a light source other than said first light source.

25. The method of claim 24 wherein said light source is a laser source.

26. The method of claim 24 wherein said light source is an LED.

27. The method of claim 24 wherein said light source is an electro-luminescent source.

28. The method of claim 1 wherein optically discharging the surface of said photoconductive unit to a fourth voltage at selected locations not to be developed by toner comprises discharging said photoconductive unit to said fourth voltage only at image locations that are less than a predetermined distance from an image location to be developed by toner.

29. The method of claim 1 wherein said first, second, third and fourth voltages are negative.

30. The method of claim 1 wherein said first, second, third and fourth voltages are positive.

31. The method of claim 1 wherein said toner comprises pigmented particles suspended in a liquid medium.

32. A method of adjusting the voltage of a photoconductive unit relative to an associated developer roller in an image forming device, comprising:

uniformly charging the surface of said photoconductive unit to a first voltage;

selectively optically discharging the surface of said photoconductive unit to a second voltage at predetermined locations to be developed by toner;

biasing the surface of said developer roller to a third voltage intermediate to said first and second voltages; and actively optically discharging the surface of said photoconductive unit to a fourth voltage at selected locations not to be developed by toner, said fourth voltage intermediate to said first and third voltages.

* * * * *